US007187336B2

(12) United States Patent
Parsche

(10) Patent No.: US 7,187,336 B2
(45) Date of Patent: Mar. 6, 2007

(54) ROTATIONAL POLARIZATION ANTENNA AND ASSOCIATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 11/167,451

(22) Filed: Jun. 27, 2005

(65) Prior Publication Data

US 2006/0290581 A1 Dec. 28, 2006

(51) Int. Cl.
*H01Q 21/00* (2006.01)
*H01Q 11/12* (2006.01)
*H01Q 7/04* (2006.01)

(52) U.S. Cl. ..... 343/728; 343/742; 343/842

(58) Field of Classification Search ..... 343/726, 343/728, 742, 842, 856
See application file for complete search history.

(56) References Cited

U.S. PATENT DOCUMENTS 3,588,905 A * 6/1971 Dunlavy, Jr. ..... 343/856
4,433,336 A * 2/1984 Carr ..... 343/728
5,592,182 A * 1/1997 Yao et al. ..... 343/742
5,784,032 A * 7/1998 Johnston et al. ..... 343/702

* cited by examiner

*Primary Examiner*—Shih-Chao Chen
(74) *Attorney, Agent, or Firm*—Allen, Dyer, Doppelt, Milbrath & Gilchrist, P.A.

(57) ABSTRACT

The antenna includes a base and a plurality of antenna feeds carried by the base for respective different rotational polarizations. A plurality of inner elongate convex coupler elements are carried by the base and connected to respective ones of the antenna feeds for respective different rotational polarizations, and a plurality of outer elongate convex resonant elements are carried by the base and extend outwardly therefrom a distance greater than the plurality of inner elongate convex coupler elements. The plurality of outer elongate convex resonant elements may be tuned to different resonant frequencies to thereby support the different rotational polarizations. Thus, a small circularly polarized antenna with a hemispherical pattern for high frequency (HF) or satellite applications is achieved.

14 Claims, 5 Drawing Sheets

ROTATIONAL POLARIZATION ANTENNA AND ASSOCIATED METHODS

FIELD OF THE INVENTION

The present invention relates to the field of antennas, and more particularly, this invention relates to circularly polarized antennas, and related methods.

BACKGROUND OF THE INVENTION

Newer designs and manufacturing techniques have driven electronic components to small dimensions and miniaturized many communication devices and systems. Unfortunately, antennas have not been reduced in size at a comparative level and often are one of the larger components used in a smaller communications device.

Circular polarization is often used in systems for communicating with earth orbiting satellites and airborne vehicles. Circularly polarized systems are advantageous in these applications because they are resistant to multipath effects, and resist the effects of fading caused by mismatched polarizations due to aircraft pitch and roll.

For background, an antenna is a transducer that converts radio frequency electric current to electromagnetic waves that are then radiated into space. The antenna may also connect electromagnetic waves into electric current. The electric field or "E" plane determines the polarization or orientation of the radio wave. In general case, most antennas radiate either linear or circular polarization.

A linearly polarized antenna radiates in one plane. In a circularly polarized antenna, the plane of polarization rotates in a circle making one complete revolution during one period of the wave. If the rotation is clockwise in the direction of propagation, the sense is called right-hand-circular polarization (RHCP). If the rotation is counterclockwise, the sense is called left-hand-circular polarization (LHCP).

An antenna is said to be vertically polarized (linear) when its electric field is perpendicular to the Earth's surface. An example of a vertical antenna is a broadcast tower for AM radio or the "whip" antenna on an automobile. Horizontally polarized (linear) antennas have their electric field parallel to the Earth's surface. Television transmissions in the United States typically use horizontal polarization.

A rotational polarized wave radiates energy in both the horizontal and vertical planes and all planes in between. The difference, if any, between the maximum and the minimum peaks as the antenna is rotated through all angles, is called the axial ratio or ellipticity and is usually specified in decibels (dB). If the axial ratio is near 0 dB, the antenna is said to be circularly polarized. If the axial ratio is greater than 1–2 dB, the polarization is often referred to as elliptical.

Circular polarization is most often used in satellite communications. This is particularly desired since the polarization of a linearly polarized radio wave may be rotated as the signal passes through any anomalies (e.g. Faraday rotation) in the ionosphere. Furthermore, due to the position of the Earth with respect to the satellite, geometric differences may vary especially if the satellite appears to move with respect to the fixed Earth bound station. Circular polarization will keep the signal constant regardless of these anomalies. Circularly polarized antennas are normally more costly than linearly polarized types since true circular polarization is difficult to attain. An example of a true circularly polarized antenna is the helix.

Quadrifilar helix antennas (QHAs) are known in the art to be circularly polarized while providing positive gain for any visible satellite location. The basic design of a QHA, such as that disclosed in U.S. Pat. No. 6,812,906 to Goldstein et al., includes two bifilar helical loops, each having two legs. These loops are oriented in a mutual orthogonal relationship on a common axis. Each of the four legs of this antenna is fed a signal that is 90 degrees apart in phase (i.e., in phase quadrature).

Other types of common circularly polarized antennas include dipole turnstiles, crossed slots and monofilar helix antennas such as a Wheeler Coil. However, an enhanced design for a small circularly polarized antenna with a hemispherical pattern may be desired for high frequency (HF) applications, low earth orbit satellites, airborne, and other mobile communication systems, for example.

SUMMARY OF THE INVENTION

In view of the foregoing background, it is therefore an object of the present invention to provide a small circularly polarized antenna with a hemispherical pattern for satellite communications or high frequency (HF) radio, and to do so without the need for a beam forming network, phasing harness, or other external RF circuitry.

This and other objects, features, and advantages in accordance with the present invention are provided by an antenna including a base, and a plurality of antenna feeds, preferably two, carried by the base for respective different rotational polarizations. A plurality of inner elongate convex coupler elements, preferably two, are carried by the base and connected to respective ones of the antenna feeds for respective different rotational polarizations, and a plurality of outer elongate convex resonant elements, preferably two, are carried by the base and extend outwardly therefrom a distance greater than the plurality of inner elongate convex coupler elements. The plurality of outer elongate convex resonant elements are tuned to different resonant frequencies to thereby support the rotational polarizations. The plurality of inner elongate convex coupler elements are nonresonant to thereby provide coupling only.

Preferably, the two inner elongate convex coupler elements are transverse to each other, and the two outer elongate convex resonant elements are transverse to each other. The two inner elongate convex coupler elements may be angularly offset with respect to the two outer elongate convex resonant elements. The two inner elongate convex coupler elements may be spaced apart at a crossing zone therebetween, and the two outer elongate convex resonant elements may be spaced apart from each other adjacent the crossing zone.

The base is preferably a conductive circular base. The outer elongate convex resonant elements may comprise a first half-loop antenna element having a first end connected to a peripheral edge of the conductive circular base and a second end capacitively coupled to the peripheral edge of the conductive circular base opposite the first end, and a second half-loop antenna element having a first end connected to the peripheral edge of the conductive circular base and a second end capacitively coupled to the peripheral edge of the conductive circular base opposite the first end. The second half-loop antenna element may be orthogonal to the first half-loop antenna element.

A method aspect of the invention is directed to making an antenna including connecting a plurality of antenna feeds to a base for respective different rotational polarizations, providing a plurality of inner elongate convex coupler elements on the base and connected to respective ones of the plurality of antenna feeds for respective different rotational polarizations, and providing a plurality of outer elongate convex resonant elements on the base and extending outwardly therefrom a distance greater than the plurality of inner elongate convex coupler elements. The method may further include tuning the plurality of outer elongate convex resonant elements to different resonant frequencies to thereby support the rotational polarizations.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
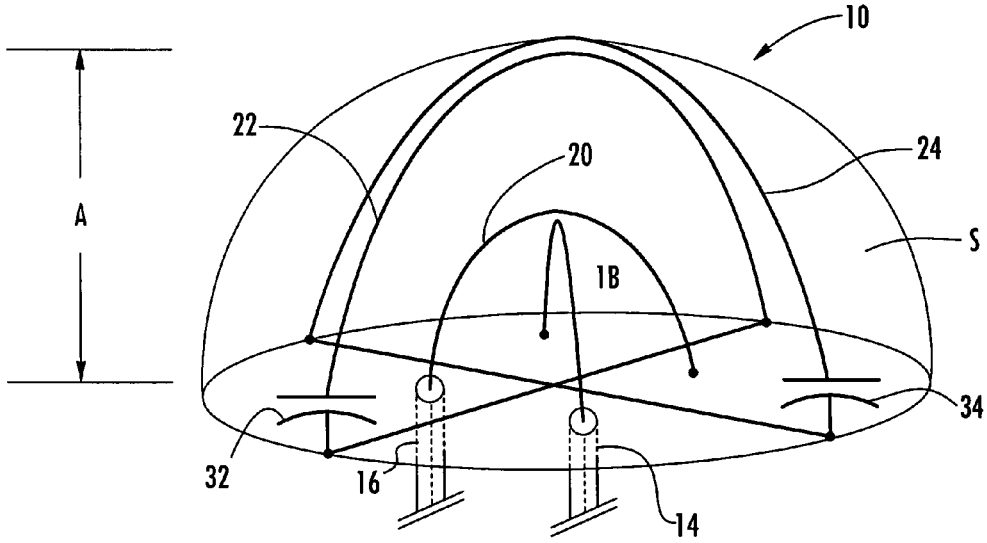
FIG. 1 is a schematic perspective view of an antenna according to the present invention.
Figure 2:
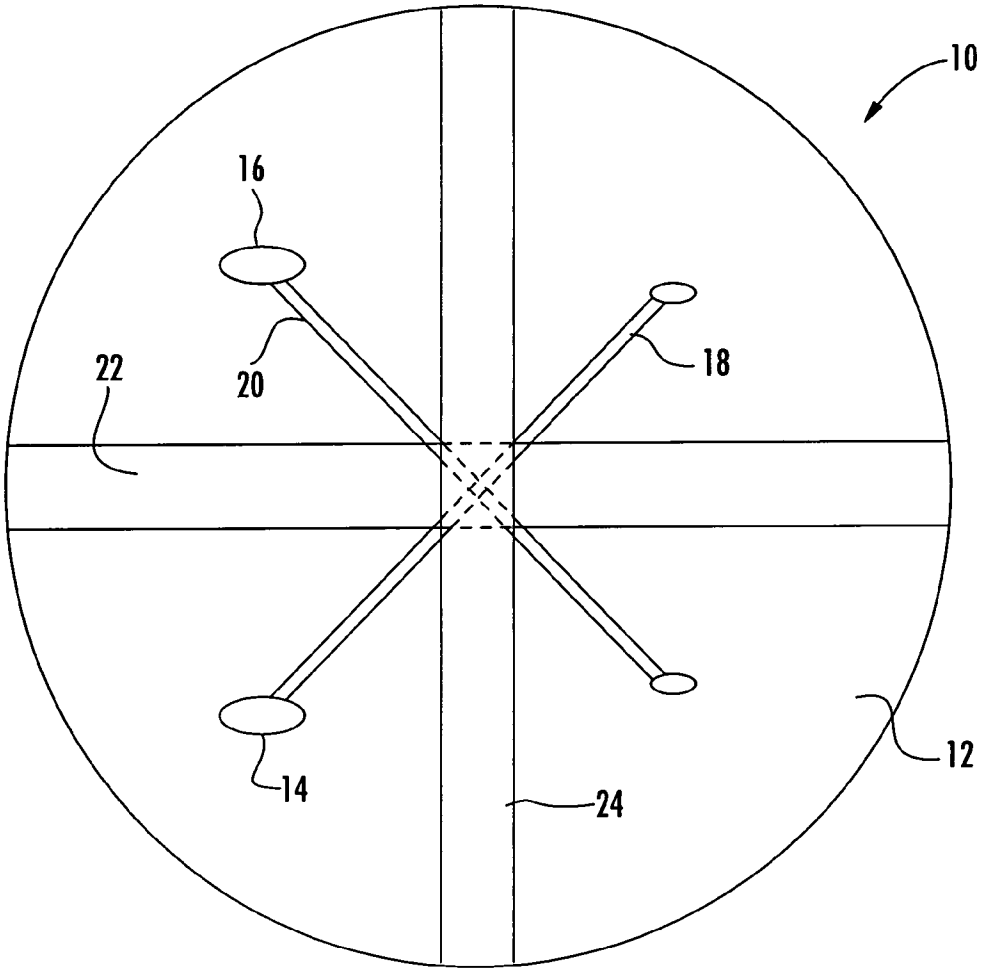
FIG. 2 is a top plan view of the antenna of FIG. 1.

Referring initially to FIGS. 1 and 2, an antenna 10 according to the present invention, e.g. a small circularly polarized antenna with a hemispherical pattern for satellite or high frequency (HF) applications, will be described. The antenna 10 includes a base 12, e.g. a conductive circular base, and antenna feeds 14, 16, carried by the base for respective different rotational polarizations.

A plurality of inner elongate convex coupler elements 18, 20 are carried by the base 12 and connected to respective ones of the antenna feeds 14, 16 for respective different rotational polarizations. Outer elongate convex resonant elements 22, 24 are carried by the base 12 and extend outwardly therefrom a distance greater than the plurality of inner elongate convex coupler elements 18, 20. The outer elongate convex resonant elements 22, 24 are illustratively half-loop antenna elements each having a first end connected to a peripheral edge of the conductive circular base 12 and a second end capacitively coupled to the peripheral edge of the conductive circular base opposite the first end. The second half-loop antenna element is orthogonal to the first half-loop antenna element.

The outer elongate convex resonant elements 22, 24 are preferably tuned to different resonant frequencies to thereby support the rotational polarizations. For example, the outer elongate convex resonant element 22 may have a loop resonant frequency ($F_r$) of 236 MHz which is equal to 0.986 $F_0$, $F_0$ being the center operating frequency of the antenna system. The outer elongate convex resonant element 24 may have a loop resonant frequency ($F_r$) of 242 MHz which is equal to $1.013F_0$. The offset resonant frequencies facilitate the quadrature phasing and circular polarization.

This invention may of course be scaled into different sizes and performance parameters traded with one another. Gains may approach 4.77 dBi when the antenna 10 is operated against a large metal ground plane and height A is about 1/18 wavelengths. At such a size metal conductivity losses become negligible in the outer elongate convex resonant elements 22, 24.

In one analysis, the outer elongate convex resonant elements 22, 24 can be considered as electrically small loop antennas, forced to resonance at slightly offset frequencies by different values of resonating capacitors 32, 34. The phase of the radiated wave from electrically small loop antennas shifts rapidly from −90 to +90 degrees above and resonance; it is but a small matter therefore to adjust resonant element 22 to lag 45 degrees in phase, and resonant element 24 to lead 45 degrees in phase, by precision setting of capacitors 32, 34. In one prototype, this 90 degree phase difference occurred when the resonant elements 22, 24 were tuned apart in frequency by 2.9 percent. This prototype produced right hand circular polarization when convex coupler element 18 was excited and left hand circular polarization when convex coupler element 20 was excited.

Figure 6:
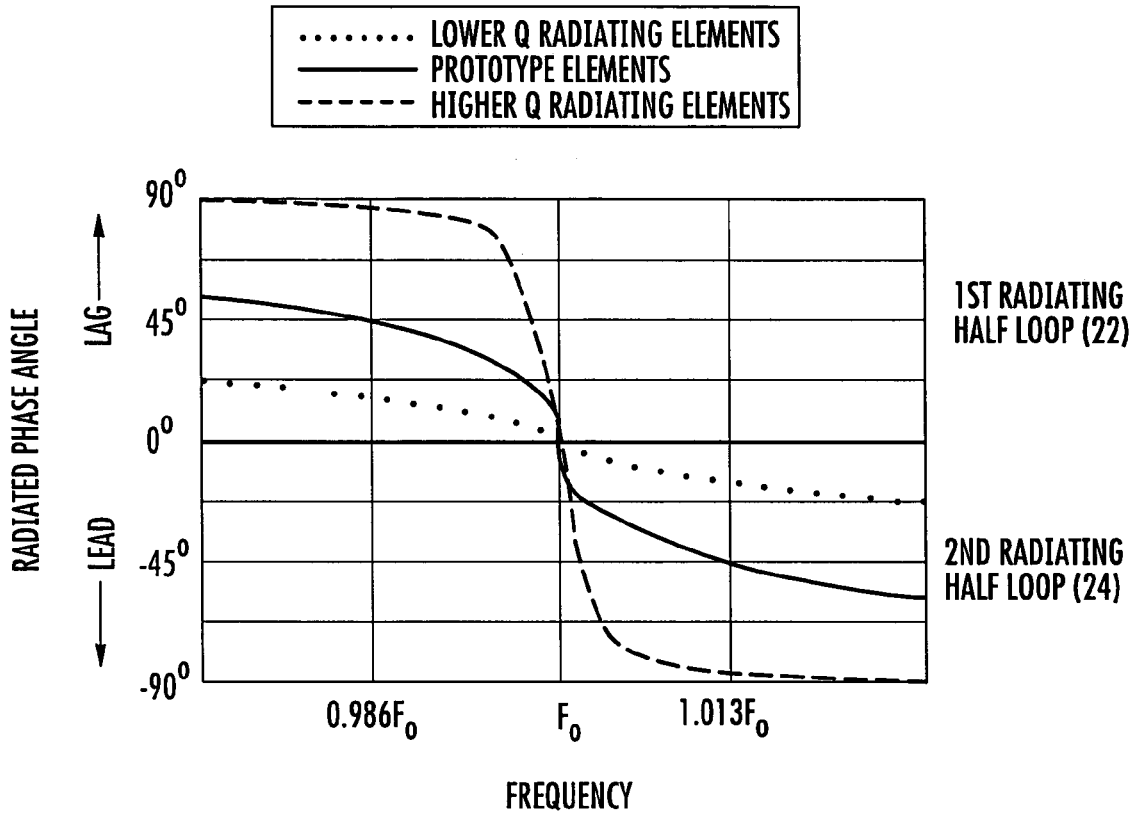
FIG. 6 is a plot of resonance and phase for the individual radiating elements of the present invention.

The exact amount of resonant frequency offset between resonant elements 22, 24 will in general vary with element Q, and will also set the pass band VSWR ripple of the antenna. FIG. 6 shows the radiated phase vs. frequency relationship for outer elongate convex resonant elements, 22, 24. This resembles the Universal Resonance Curve For Parallel Resonant Circuits, as will be appreciated by those skilled in the art.

Antenna 10 exhibits a second order tchebyschev bandpass filter type frequency response with a controlled passband ripple. This is beneficial, as the bandwidth afforded by this polynomial response is many times that of a single tuned antenna. In one prototype, a peak of ripple of 2.0 to 1 VSWR was adjusted for, and the total passband under 2.0 to VSWR was about 400 percent higher than the passband of an individual resonant element 22, 24 alone.

The inner elongate convex coupler elements 18, 20 are non-resonant and are variometer couplers for the resonating elements 22, 24. For example, the inner elongate convex coupler element 18 may be for left hand rotational polarization while the inner elongate convex coupler element 20 is for right hand rotational polarization. The inner elongate convex coupler elements 18, 20 are isolated from each other; accordingly, one may be used for transmission while the other is used for reception, i.e. simultaneous full duplex.

In a circuit equivalent type analysis, inner elongate convex coupler elements 18, 20 can be viewed to function as transformer windings with respect the two outer elongate convex resonant elements 22, 24. In this line of thought, antenna 10 is a transformer having two nonresonant primary windings and two resonant secondary windings.

Inner elongate convex coupler elements 18, 20 couple to the radial magnetic near fields of the two outer elongate convex resonant elements 22, 24. The size of inner elongate convex coupler elements 18, 20 sets the resistance that this antenna provides, at antenna feeds 14, 16, and this resistance is adjusted to 50 ohms in ordinary practice. Antenna feeds 14, 16 are isolated ports with respect to each other that can be used for duplex communications. Isolation levels of 19 to 28 dB have been observed in practice.

The height A of antenna 10 is preferably between 1/82 and 1/6 wavelengths, the lower bound being determined by conductor losses relative to radiation resistance and the upper bound set by current distribution along outer elongate convex resonant elements 22, 24. At such sizes, outer elongate convex resonant elements 22, 24 are electrically small half loop antennas, which have approximately a uniform current distribution, in amplitude and phase. Outer elongate convex resonant elements 22, 24 are therefore without separation of charge or dipole moment, and have reactive near fields that are radial and magnetic. This facilitates the transformer coupling mechanism to inner elongate convex coupling elements 18, 20.

As discussed above, a rotationally polarized wave radiates energy in both the horizontal and vertical planes and all planes in between. Circular polarization is most often used in satellite communications. This is particularly desired since the polarization of a linear polarized radio wave may be rotated as the signal passes through any anomalies (e.g. Faraday rotation) in the ionosphere. Furthermore, due to the position of the Earth with respect to the satellite, geometric differences may vary especially if the satellite appears to move with respect to the fixed Earth bound station. Circular polarization tends to keep the signal constant regardless of these anomalies.

As shown in the illustrated embodiment, the two inner elongate convex coupler elements 18, 20 are transverse to each other, and the two outer elongate convex resonant elements 22, 24 are transverse to each other. The two inner elongate convex coupler elements 18, 20 are angularly offset with respect to the two outer elongate convex resonant elements 22, 24 by forty-five degrees. The two inner elongate convex coupler elements 18, 20 are spaced apart at a crossing zone therebetween, and the two outer elongate convex resonant elements 22, 24 are spaced apart from each other adjacent the crossing zone. The shape and positioning of the outer elongate convex resonant elements 22, 24 defines an imaginary semi-spherical surface S with a height in a range of about 1/82 to 1/6 wavelengths, as illustrated in FIG. 1.

Figure 4:
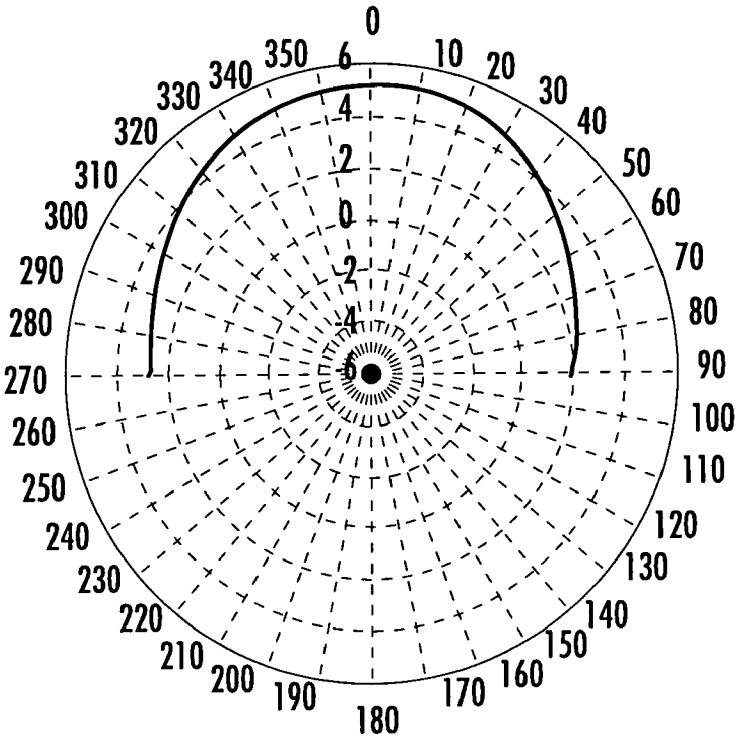
FIG. 4 is a radiation pattern, elevation cut in the XZ plane including gain in dBi, for the antenna of FIGS. 1 and 2.
Figure 3:
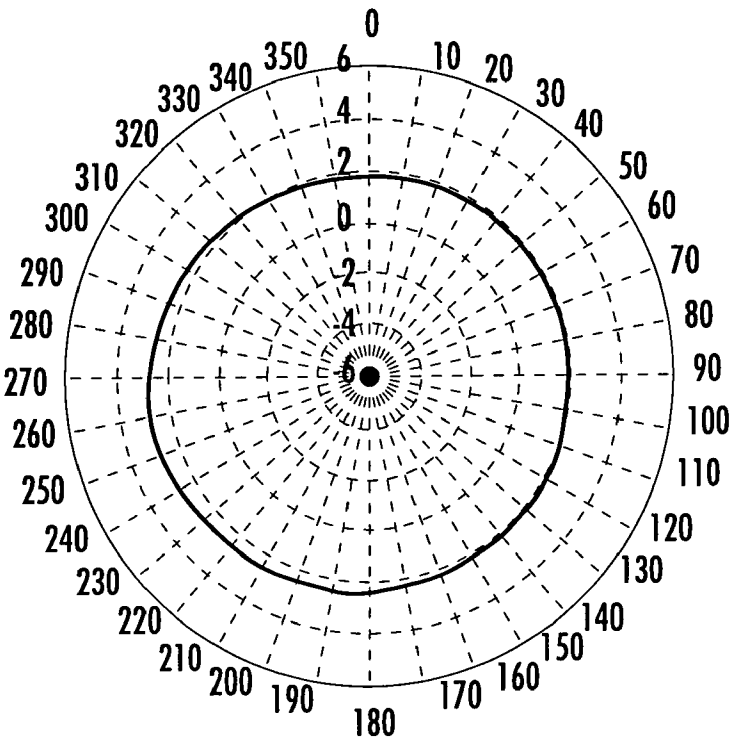
FIG. 3 is a radiation pattern, azimuth cut in the XY plane including gain in dBi, for the antenna of FIGS. 1 and 2.
Figure 5:
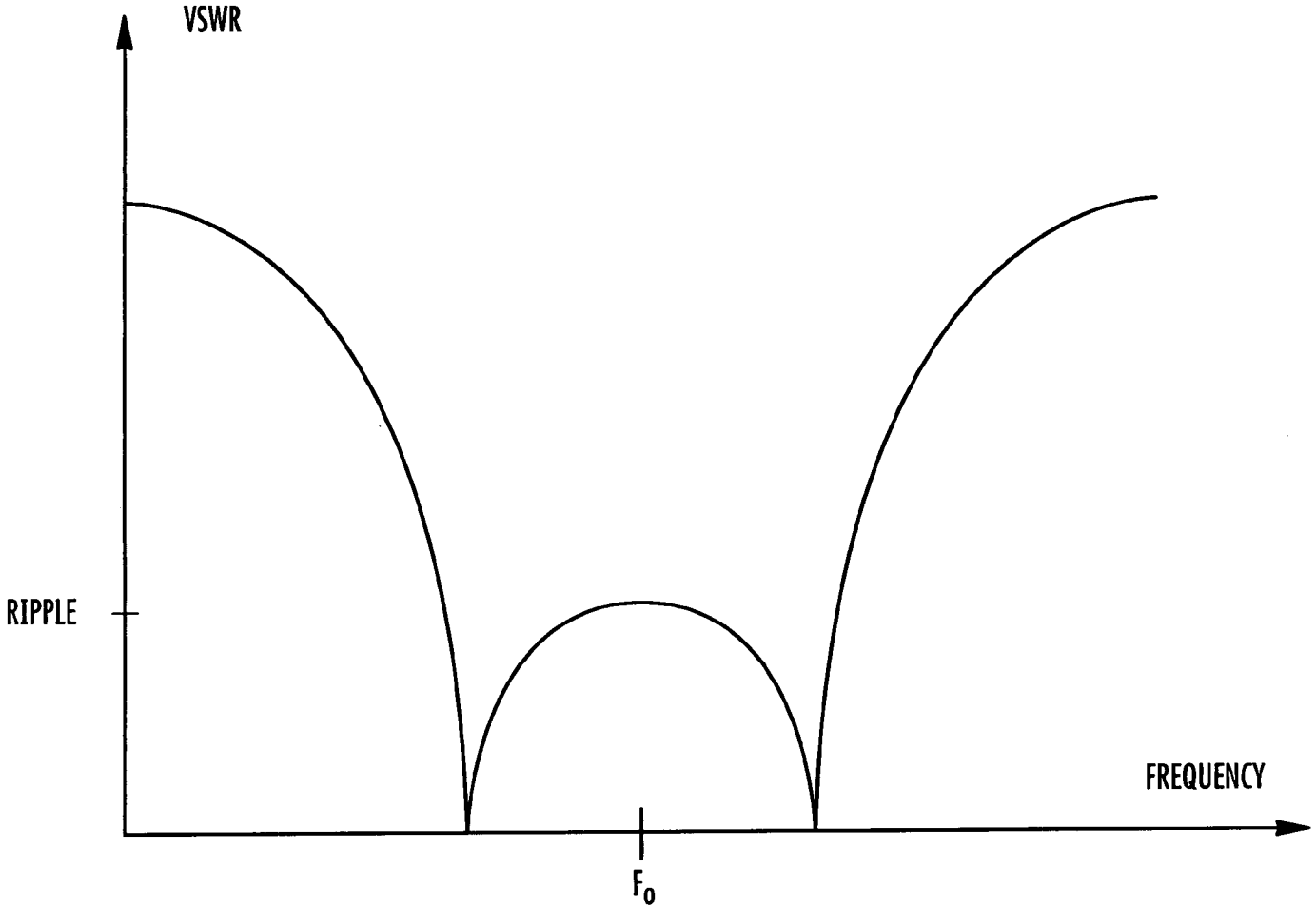
FIG. 5 is a VSWR plot for the ports of the present invention.

With reference to the radiation patterns illustrated in FIGS. 3 and 4, and the Table 1 provided below, an example of a selectable right/left hand circular polarization antenna in accordance with the present invention has an operating frequency of 3 MHz, an electrical height of 1/82 wavelengths, a physical height of 4.0 feet, and a 2.0:1 VSWR bandwidth of 6 Khz. The gain would be +1.4 dBi, and the antenna would operate at an efficiency of 46%. A radiation pattern, azimuth cut in the XY plane including gain in dBi, for such an antenna is shown in FIG. 3. Likewise, FIG. 4 shows a radiation pattern, elevation cut in the XZ plane including gain in dBi, for the antenna.

TABLE 1

| NVIS/HF Antenna Example | |
|---|---|
| Frequency | 3 Mhz |
| Height A | 4 feet (1/82 wavelengths) |
| Radiating Elements | 1 foot wide copper foil straps |
| Element Radiation Resistance | 0.83 milliohms |
| Element Loss Resistance | 0.88 milliohms |
| Resonating Capacitors | Vacuum Variable, Connections Heavily Soldered |
| Resonating Capacitor Loss Resistance (ESR) | 0.1 milliohms |
| Radiation Efficiency | 46 Percent |
| Resonating Capacitance | 1550 picofarads |
| Directivity | 4.77 dB |
| Gain | +1.4 dBi |
| Polarization At Zenith | circular, selectable sense |

TABLE 1-continued

| NVIS/HF Antenna Example | |
|---|---|
| Frequency | 3 Mhz |
| Polarization On Horizon | vertical |
| Instantaneous 2.0 to 1 VSWR Bandwidth | more than 6 kilohertz |
| Radiating Element Q | 6,000 to 11,000, depending on construction |
| Coupler Resistance | 50 ohms/adjustable |
| Tunable Bandwidth | 3–25 Mhz |

An example of this antenna for 1575.42 Mhz and Global Positioning Service GPS use is provided in Table 2 below.

TABLE 2

| GPS Receive Antenna Example | |
|---|---|
| Frequency | 1575.42 Mhz |
| Height A | 0.40 inch (1/19 wavelengths) |
| Radiating Elements | 22 gauge wire (0.025 inch diameter) |
| Element Radiation Resistance | 310 milliohms |
| Radiating Element Loss Resistance | 160 milliohms |
| Resonating Capacitors | Ceramic |
| Resonating Capacitor Loss Resistance (ESR) | negligible |
| Radiation Efficiency | 66 percent |
| Directivity | 4.77 dB |
| Gain | +2 to 3 dBi, depending on construction |
| Polarization | Right Hand Circular |
| Coupler Resistance | 50 ohms |

A method aspect of the invention is directed to making an antenna 10 including connecting the plurality of antenna feeds 14, 16 to the base 12 for respective different rotational polarizations, providing the plurality of inner elongate convex coupler elements 18, 20 on the base and connected to respective ones of the plurality of antenna feeds for respective different rotational polarizations, and providing the plurality of outer elongate convex resonant elements 22, 24 on the base and extending outwardly therefrom a distance greater than the plurality of inner elongate convex coupler elements. The method further includes tuning the plurality of outer elongate convex resonant elements 22, 24 to different resonant frequencies to thereby support the rotational polarizations.

The present invention provides vertical linear polarization on the horizon, and in the plane of base 12. The azimuth pattern is circular or omnidirectional to a minor ripple. This invention is therefore useful for land mobile radio communications.

The present invention has a broad tunable bandwidth extending over several octaves when capacitors 32, 34 are of the variable type, and the actual tuning range is the square root of the capacitance range. This invention is therefore well suited for the narrow instantaneous bandwidth and broad tunable bandwidth requirements of high frequency systems. The hemispherical pattern coverage of this antenna favors both long range and short range near vertical incidence scattering (NVIS) communications at HF.

The present invention has the additional advantage of allowing selection of the sense of rotational polarization to reject electron gyroresonance noise in the lower HF and MF spectrum, as described by K. Davies in "Ionospheric Radio Propagation", National Bureau Of Standards Monograph 80, Apr. 1, 1965.

It can also be appreciated that the present invention provides a small compact antenna for lower frequencies, and is useful for launching surface or ground waves for long range over the horizon communications.

The present invention has the unusual advantage of not needing a ground plane or counterpoise beyond base 10 for efficient operation on soils at HF. The reason for this is that outer elongate convex resonant elements 22, 24 are by nature electrically small loop antennas having radial only magnetic near fields, and that the surrounding soil does not have permeability or loss properties to magnetic near fields. Typical soils can have properties of about relative permittivity 13, relative permeability 1.0, and conductivity 0.005 mhos/meter, with the significant loss mechanism being the high molecular dipole moment of water to E fields. This mechanism does not exhibit loss properties to magnetic near fields.

By way of explanation, magnetic fields interact inside atoms by modifying electron spin, while electric fields interact between atoms. In other words, polar molecules of water vibrate in the presence of RF electric near fields, but do not vibrate in the presence of RF magnetic near fields. This invention produces radial near fields that are magnetic, to take advantage of the non-magnetic properties of water, soil, and human flesh.

In a preferred deployment at HF, base 10 is elevated slightly above and insulated from the soil, to eliminate any stray current flow thereto. Similarly to soils at HF, the human body at UHF is lossy to electric near fields but not so to magnetic near fields. This invention is a useful body worn antenna, having low losses from proximity to human flesh, and exceptionally stable frequency of operation.

The present invention is well suited for global positioning satellite (GPS) receiver service at 1575.42 Mhz. In one embodiment, base 12 is conical for synthesis of preferred elevation plane pattern shapes.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna comprising:

a conductive circular base;

a plurality of antenna feeds carried by said base for respective different rotational polarizations;

a plurality of inner elongate convex coupler elements carried by said base and connected to respective ones of said plurality of antenna feeds for respective different rotational polarizations; and a plurality of outer elongate convex resonant elements carried by said base and extending outwardly therefrom a distance greater than said plurality of inner elongate convex coupler elements;

said plurality of outer elongate convex resonant elements tuned to different resonant frequencies to thereby support the different rotational polarizations;

said plurality of outer elongate convex resonant elements comprising a first half-loop antenna element having a first end connected to a peripheral edge of the conductive circular base and a second end capacitively coupled to the peripheral edge of the conductive circular base opposite the first end, and a second half-loop antenna element having a first end connected to the peripheral edge of the conductive circular base and a second end capacitively coupled to the peripheral edge of the conductive circular base opposite the first end, the second half-loop antenna element being orthogonal to the first half-loop antenna element.

2. The antenna according to claim 1 wherein the plurality of antennas feeds comprises two antenna feeds, and the plurality of inner elongate convex coupler elements comprises two inner elongate convex coupler elements.

3. The antenna according to claim 2 wherein the two inner elongate convex coupler elements are transverse to each other, and the first and second half-loop antenna elements are transverse to each other.

4. The antenna according to claim 3 wherein the two inner elongate convex coupler elements are angularly offset with respect to the first and second half-loop antenna elements.

5. The antenna according to claim 3 wherein the two inner elongate convex coupler elements are spaced apart at a crossing zone therebetween, and the first and second half-loop antenna elements are spaced apart from each other adjacent the crossing zone.

6. The antenna according to claim 1 wherein the base comprises a conductive base.

7. An antenna comprising:

a conductive circular base;

two antenna feeds carried by said base for respective different rotational polarizations;

two inner elongate convex coupler elements carried by said base and connected to respective ones of the two antenna feeds for respective different rotational polarizations; and two outer elongate convex resonant elements carried by said base and extending outwardly therefrom a distance greater than the two inner elongate convex coupler elements;

the two inner elongate convex coupler elements being transverse to each other, the two outer elongate convex resonant elements being transverse to each other, and the two inner elongate convex coupler elements being angularly offset with respect to the two outer elongate convex resonant elements;

the two outer elongate convex resonant elements comprising a first half-loop antenna element having a first end connected to a peripheral edge of the conductive circular base and a second end conductive circular base opposite the first end, and a second half-loop antenna element having a first end connected to the peripheral edge of the conductive circular base and a second end capacitively coupled to the peripheral edge of the conductive circular base opposite the first end.

8. The antenna according to claim 7 wherein the first and second half-loop antenna elements are tuned to different resonant frequencies to thereby support the different rotational polarizations.

9. The antenna according to claim 7 wherein the two inner elongate convex coupler elements are spaced apart at a crossing zone therebetween, and the first and second half-loop antenna elements are spaced apart from each other adjacent the crossing zone.

10. A method of making an antenna comprising:

connecting a plurality of antenna feeds to a conductive circular base for respective different rotational polarizations;

providing a plurality of inner elongate convex coupler elements on the base and connected to respective ones of the plurality of antenna feeds for respective different rotational polarizations; and providing a plurality of outer elongate convex resonant elements on the base and extending outwardly therefrom a distance greater than the plurality of inner elongate convex coupler elements;

tuning the plurality of outer elongate convex resonant elements to different resonant frequencies to thereby support the different rotational polarizations;

the plurality of outer elongate convex resonant elements comprising a first half-loop antenna element having a first end connected to a peripheral edge of the conductive circular base and a second end capacitively coupled to the peripheral edge of the conductive circular base opposite the first end, and a second half-loop antenna element having a first end connected to the peripheral edge of the conductive circular base and a second end capacitively coupled to the peripheral edge of the conductive circular base opposite the first end, the second half-loop antenna element being orthogonal to the first half-loop antenna element.

11. The method according to claim 10 wherein the plurality of antennas feeds comprises two antenna feeds, and the plurality of inner elongate convex coupler elements comprises two inner elongate convex coupler elements.

12. The method according to claim 11 wherein the two inner elongate convex coupler elements are transverse to each other, and the first and second half-loop antenna elements are transverse to each other.

13. The method according to claim 12 wherein the two inner elongate convex coupler elements are angularly offset with respect to the first and second half-loop antenna elements.

14. The method according to claim 12 wherein the two inner elongate convex coupler elements are spaced apart at a crossing zone therebetween, and the first and second half-loop antenna elements are spaced apart from each other adjacent the crossing zone.

* * * * *

UNITED STATES PATENT AND TRADEMARK OFFICE

CERTIFICATE OF CORRECTION

PATENT NO. : 7,187,336 B2
APPLICATION NO. : 11/167451
DATED : March 6, 2007
INVENTOR(S) : Parsche It is certified that error appears in the above-identified patent and that said Letters Patent is hereby corrected as shown below:

| | |
|---|---|
| Column 4, Line 12 | Delete: "resonance"<br>Insert: -- resonate -- |
| Column 4, Line 15 | Delete: " and" |
| Column 4, Line 38 | Delete: " to VSWR "<br>Insert: -- to 1 VSWR -- |
| Column 8, Line 49 | Delete: "end conductive"<br>Insert: -- end capacitively coupled to the peripheral edge of the conductive -- |

Signed and Sealed this

Seventh Day of August, 2007

JON W. DUDAS
*Director of the United States Patent and Trademark Office*